US005137053A

United States Patent [19]

Kale

[11] Patent Number: 5,137,053

[45] Date of Patent: Aug. 11, 1992

[54] STORAGE TANK FOR WATER HEATERS AND THE LIKE WITH DIFFUSER INLET

[76] Inventor: Hemant D. Kale, 8253 Sugarland Dr., Manlius, N.Y. 13104

[21] Appl. No.: 735,791

[22] Filed: Jul. 25, 1991

[51] Int. Cl.[5] ..... E03B 11/00

[52] U.S. Cl. ..... 137/592; 137/561 A; 137/341

[58] Field of Search ..... 137/341, 592, 561 A

[56] References Cited

U.S. PATENT DOCUMENTS

| | | | |
|---|---|---|---|
| 2,059,255 | 11/1936 | Lassiat | 137/561 A |
| 2,123,809 | 7/1938 | Seitz | 137/592 |
| 2,602,465 | 7/1952 | Goehring | 137/592 |
| 2,711,756 | 6/1955 | Peck et al. | 137/592 |
| 3,158,177 | 11/1964 | Schulz et al. | 137/592 |
| 3,244,197 | 4/1966 | Stilwell | 137/592 |
| 4,140,178 | 2/1979 | Ohlswager et al. | 137/561 A |
| 4,294,310 | 10/1981 | Reusch et al. | 137/592 |
| 4,299,553 | 11/1981 | Swaroop | 137/561 A |
| 4,580,597 | 4/1986 | Cordingley et al. | 137/561 A |
| 4,609,010 | 9/1986 | Watson | 137/561 A |

*Primary Examiner*—A. Michael Chambers
*Attorney, Agent, or Firm*—John C. Shepard

[57] ABSTRACT

A storage tank having a vertical, cylindrical tank, a fluid inlet, and a fluid outlet, includes an inlet diffuser for introducing inlet cold water uniformly across a horizontal cross section of the tank bottom and thereby foil convection currents that cause mixing of hot and cold fluid so that more hot fluid is recovered at the outlet over time. The tank may comprise a hot water heater where the water stored in the tank is heated within the tank by means disposed internally or externally of the internal storage chamber. Alternately, the water may be heated externally of the tank and stored within the tank.

20 Claims, 8 Drawing Sheets

STORAGE TANK FOR WATER HEATERS AND THE LIKE WITH DIFFUSER INLET

BACKGROUND OF THE INVENTION 1.

Technical Field

This invention relates generally to storage tanks for hot fluids and, more particularly, to hot water storage tanks such as water heaters.

In the prior art, a storage-tank water heater replaces hot water withdrawn from the top of the tank with cold water delivered to the bottom of the tank. Because typical tank heating elements cannot heat the water as fast as it is withdrawn, cold water will eventually fill the tank. Even before the tank is filled with cold water, the incoming cold water mixes freely with the heated standing water in the tank thereby causing deterioration of the tank's water temperature. This mixing is partially the result of the currents generated by the inward flow of cold water, by the outward flow of hot water, and by the convection currents established within the tank.

Because of this mixing, hot water delivered by a typical hot water heater will gradually decrease in temperature while water is being withdrawn, only a small amount of high temperature water is delivered relative to the tank's total capacity. The hot water volume delivered to the outlet above a specified temperature can obviously be extended by increasing the size of the tank or by increasing the BTU input of the heating elements or gas/oil burner. The temperature of hot water at the outlet can also be maintained by preventing the mixing of hot and cold water within the tank.

Attempts have been made in the past to contain and control the mixing of hot and cold water by providing separate chambers within the tank for cold and hot water. Miller U.S. Pat. Nos. 2,833,273 and 3,244,166 employ separate mixing chambers within the tank at the inlet. Gulick U.S. Pat. No. 2,207,057 uses a small baffle over the inlet to control mixing, while Downs et al. U.S. Pat. No. 3,987,761 employs a baffle plate with large openings. Hammersley U.S. Pat. No. 3,062,233 simply uses a small inverted inlet cover. Fox U.S. Pat. No. 787,909 and Andrews U.S. Pat. No. 4,390,008 show the use of a vertically movable barrier. In Schauer, Jr. U.S. Pat. No. 2,809,267, a braided tube is attached to the cold water inlet located adjacent the tank bottom to control the turbulent introduction of cold water into the tank and in an attempt to maintain the stratification of hot water above cold water.

In substantially different constructions employing the concept of compartmentalization, Jacoby U.S. Pat. No. 2,625,138 divides the tank into a plurality of separate vertical layers by using numerous horizontal baffles and Pruitt U.S. Pat. No. 2,311,469 shows a fuel burner in which several secondary combustion chambers stratify the water in the storage tank.

McAlister U.S. Pat. No. 4,436,058 attempts to minimize convection tendencies by confining water in numerous capillary type conduits stretched between the tank bottom and the tank top. Schuell U.S. Pat. No. 1,689,935 attempts to obtain constant temperature of water by continuously varying the energy input to the tank by using a feedback control system involving a thermostat.

While these prior art designs tried to reduce flow created by the usual high velocity of incoming cold water and tried to separate hot and cold water layers, none have taken note of the existence of possible convection currents and, thus, none limit the formation of these thermal currents in the tank and concurrently preserve the smooth horizontal boundary layer between hot and cold water within the tank. Further, these convection thermal currents are believed to flow primarily along the smooth side surfaces of the tank. In pressurized tanks, these currents are enhanced by the smooth inner surface of the curved top, the "domed" top being common in pressure tanks because of their structural strength. These closed loop currents greatly enhance the mixing of hot and cold water. My U.S. Pat. Nos. 4,632,065 and 4,739,728 attempt to stop mixing caused by these convection currents.

Convection currents are believed to be generated by physical turbulence resulting from high velocity of inrushing cold water and by thermal imbalance created by the localized dumping of cold water into the tank. None of the above patents is concerned with reducing or minimizing convection currents near the cold water inlet. Further, none of the above patents is concerned with reducing or minimizing convection currents resulting from thermal imbalance created due to localized dumping of cold water. If cold water is introduced uniformly throughout a horizontal cross section of the heater tank, these convection currents can be minimized.

In the above-referenced patents, mixing of cold water is prevented in a more active manner by presenting a physical obstruction to convection currents. The new constructions disclosed herein prevent mixing in a more passive manner by foiling convection currents by use of a diffuser inlet dip tube. In contrast to the single point inlet presently employed in heaters, the diffuser inlet introduces water evenly across a horizontal cross section of the tank. In this way, the possibility of establishing closed loop convection currents is minimized. In effect, this foils the convection currents that would otherwise be established within the tank which cause mixing. This aspect of minimizing mixing by use of an inlet diffuser which introduces cold water uniformly across a horizontal cross section is novel, unique and very cost effective.

SUMMARY OF THE INVENTION

The present invention is directed to overcoming one or more of the problems as set forth above.

According to the present invention, a storage tank has a diffuser inlet which introduces cold water evenly across a horizontal cross section in the tank bottom. As hot water is withdrawn, cold water is introduced uniformly across a horizontal cross section in the tank bottom minimizing any currents in the body of the water, which in the presence of localized dumping of cold water would move within the tank. By minimizing these currents which cause mixing, the smooth boundary layer between the hot water and the incoming cold water is maintained. Thus, more hot water is withdrawn from the tank.

In one exemplary embodiment of the invention, a diffuser inlet having essentially the same diameter as the tank's internal diameter is utilized with a conventional electric hot water heater and is secured to and supported in position by the inlet dip tube with the tube opening being located below diffuser plate. Openings are provided in the diffuser plate to introduce cold water evenly across an entire horizontal cross section of the tank.

In other exemplary embodiments of the invention, the diffuser is constructed to define several concentric circles, or is helical or spider-shaped to position the openings evenly across the entire horizontal cross section of the top of tank's internal storage area.

In another embodiment of the invention, a diffuser plate having a diameter slightly smaller than the tank's internal diameter is placed horizontally in the bottom of the tank just above the inlet dip tube opening. This diffuser plate will introduce cold water uniformly along the inside periphery of the tank, the incoming water moving in an upward direction. These upward currents will oppose and counter downward moving convection currents and thereby foil or nullify any tendency to establish closed loop convection currents that cause mixing.

In another embodiment of the invention, an arcuate or circular diffuser tube having a diameter slightly smaller than the tank's internal diameter is placed horizontally in the bottom of the tank. This diffuser tube will introduce cold water uniformly along the inside periphery of the tank, the incoming water moving upwardly to oppose and counter downward moving convection currents and thereby foil or nullify any tendency to establish closed loop convection currents that cause mixing.

The material of the diffuser tube or plate may vary to suit the application. A material similar to that comprising that of the inlet dip tube would be appropriate, including heat resistant thermoplastic. The openings defined in the diffuser tube or plate may be of any suitable size and shape and may vary in quantity to permit introduction of cold water in a uniform manner across a horizontal cross section of the tank.

An advantage of the invention is that the tank will deliver more hot water, in gallons, at a relatively high temperature. A further feature of the invention is the minimization of the mixing of hot and cold water within the tank by the simplest and least expensive means possible.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENTS

Best Modes for Carrying Out the Invention

Figure 1:
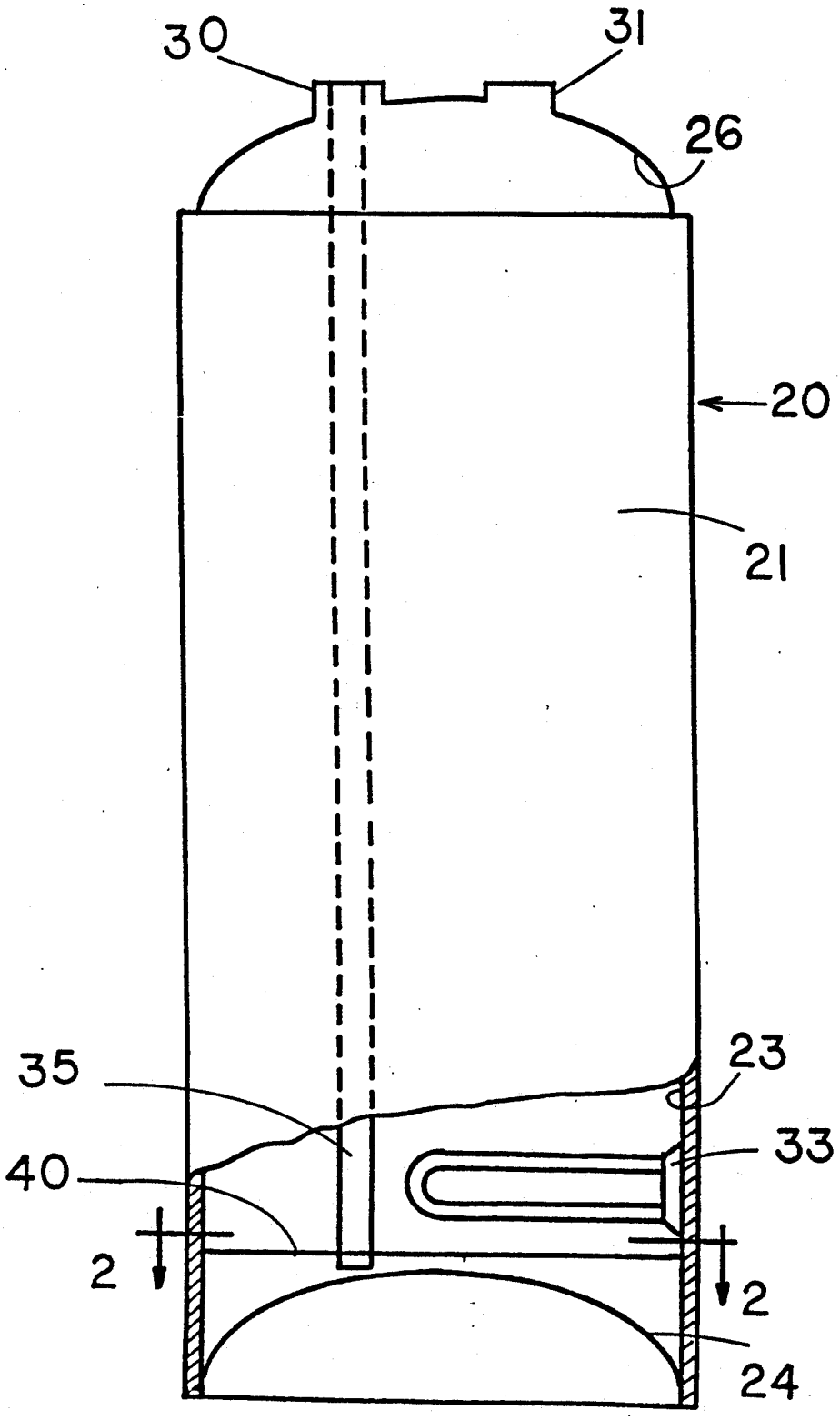
FIG. 1 is a side elevational view, partially in section, of a first embodiment of the present invention showing the use of a dip tube with a perforated diffuser plate in a water heater storage tank.
Figure 2:
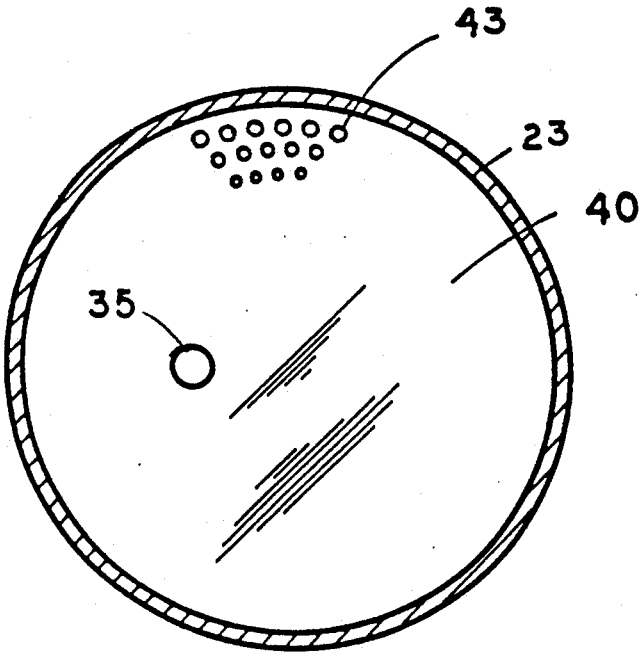
FIG. 2 is a cross-sectional view of the tank taken along line 2—2 of FIG. 1.

Referring to FIGS. 1 and 2 of the drawings, a conventional, non-compartmentalized hot water heater, generally designated 20, has a storage tank 21 with an upright, vertical axis. The internal hot water storage chamber of the tank 21 is defined by a cylindrical side wall 23, a bottom wall 24 and an outwardly concave top wall 26. The tank 21 has a cold water inlet 30 and a hot water outlet 31 generally adjacent the top thereof. Both the inlet 30 and the outlet 31 are radially spaced from the tank axis. The cold water inlet may be located adjacent to the tank bottom. As shown herein, electric heating elements 33 may be employed to heat the water within the tank. Alternately, the water may be heated externally and stored in the tank. The tank 21 may also have an opening (not shown) for a temperature-pressure relief valve.

When in operation, hot water is withdrawn from the top of the tank 21 by way of the outlet 31. Cold water replacing the water withdrawn is introduced to the tank 21 by way of the inlet dip tube 35.

In a first embodiment of the invention as shown in FIGS. 1 and 2, a diffuser plate 40 is located in the bottom of the tank. The diffuser plate 40 is provided with a series of perforations, collectively designated 43, throughout its surface. FIG. 2 shows only a small portion of the perforations 43 which circle the plate and may extend from the plate's center to its outer periphery. The cold water inlet dip tube 35 may be used to support the diffuser plate 40. As the cold water enters the tank bottom, it is diffused uniformly through the opening pores 43 in the diffuser plate across a horizontal cross section of the tank. This minimizes thermal imbalance that would otherwise be created if the cold water were delivered in a single location. Such an imbalance would encourage and generate convection currents that cause mixing. Further, as the cold water moves upwards uniformly across a cross section, the upward currents will counter and nullify any downwardly moving currents. Minimizing convection currents in this manner—by both minimizing thermal imbalance and by creating counter currents—the heat transfer from heated water to the incoming cold water will largely be due to heat conduction. Since the thermal conductivity of water is relatively very low, losses due to mixing of hot and cold water will be minimized.

Figure 2A:
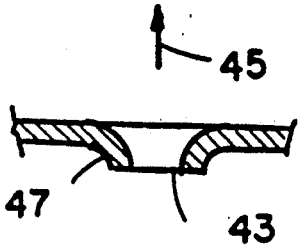
FIG. 2A is a cross-sectional view of a portion of the diffuser plate of FIG. 2 showing the construction of one perforation.

FIG. 2A shows one form of the perforated opening 43 in the diffuser plate 40. The size of the horizontal cross section of the opening, which may be circular, increases in the direction of upward water flow as indicated by arrow 45. The expanding cross section will further inhibit any likely turbulence. The opening 43 may be defined by a downwardly extending nipple 47 as shown.

To further insure even and uniform distribution of water, the pores 43 nearer to the water inlet opening may be sized relatively smaller than the pores farther from the water inlet opening. Note that all of the pores or openings are relatively small compared to the diameter of the inlet tube so that the volume and velocity of water introduced at any single opening into the tank is also small even though the total inflow may be large. By providing inlet water from a large number of low volume, low velocity openings, rapid mixing of inlet and tank water is minimized.

Figure 3:
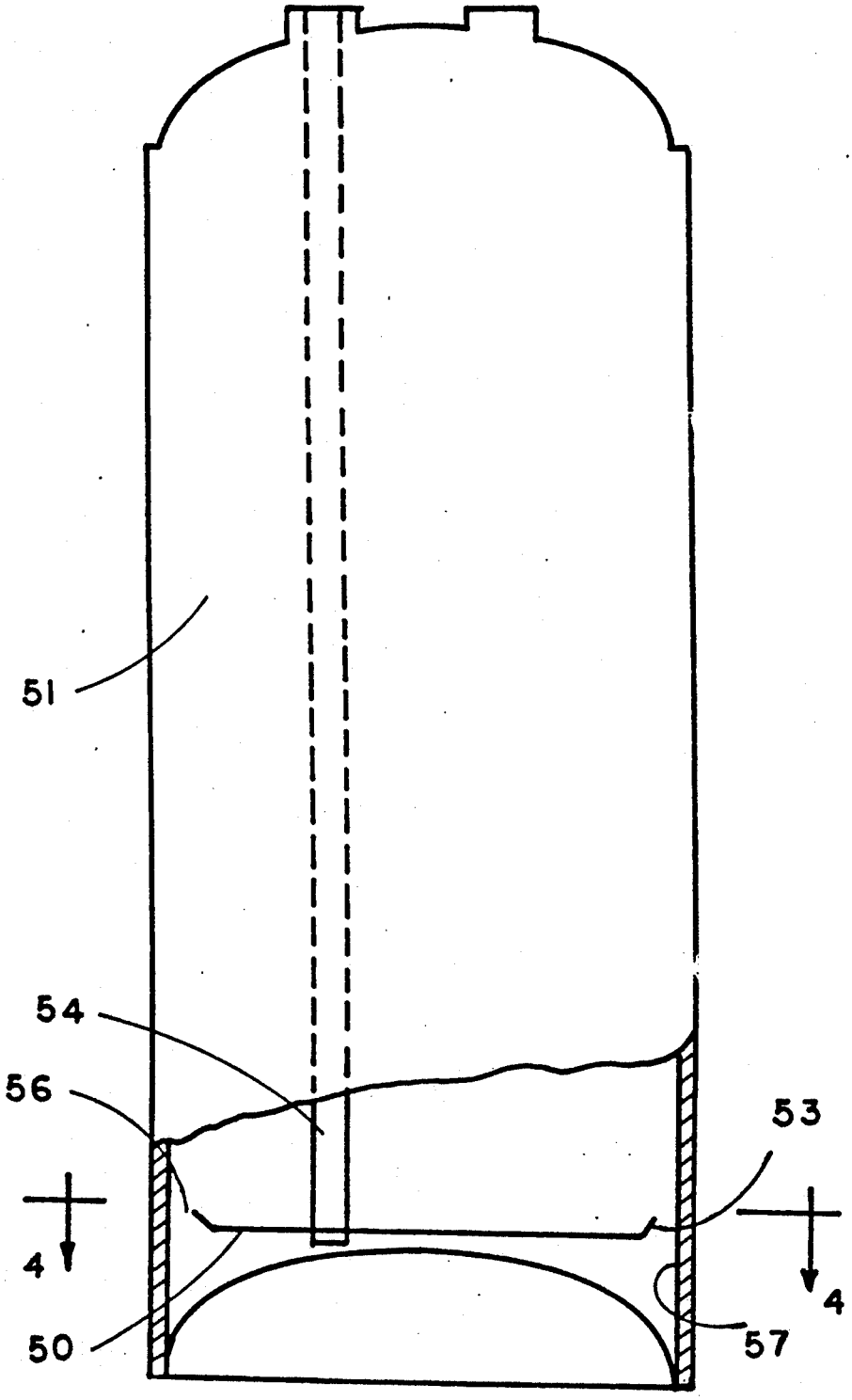
FIG. 3 is a side elevational view, partially in section, of a second embodiment of the present invention showing the use of a dip tube with a solid diffuser plate in a water heater.
Figure 4:
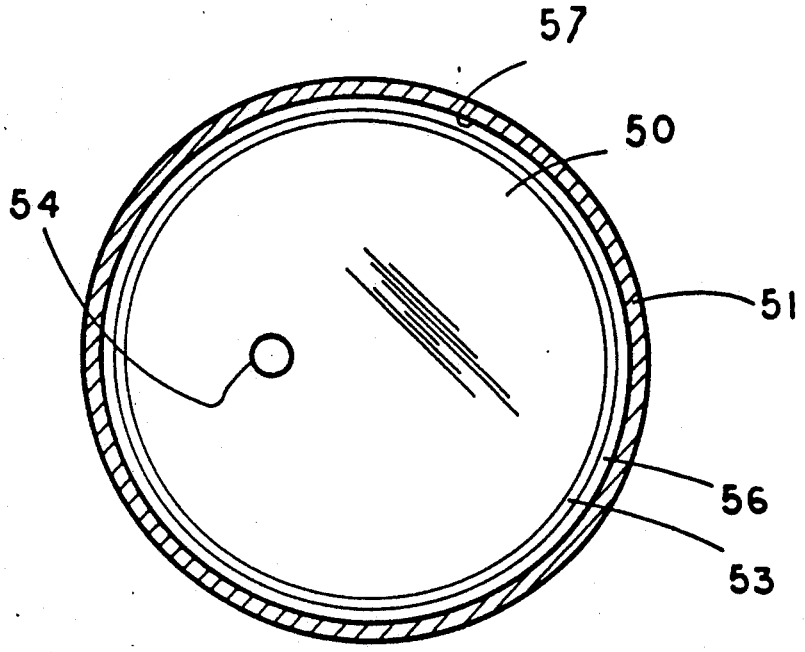
FIG. 4 is a cross-sectional view of the tank taken along line 4—4 of FIG. 3.

In a second embodiment of the invention as shown in FIGS. 3 and 4, a diffuser plate 50 has a diameter that is slightly smaller than the internal diameter of the tank 51. The diffuser plate 50 is solid with no openings and has a raised or bent peripheral rim 53. The diffuser plate 50 may be secured to the inlet dip tube 54 or may be force fit or gravity seated. After the cold water enters the tank bottom, the diffuser plate 50 introduces it uniformly along the periphery in a horizontal cross section of the tank interior. The gap 56 between the tank interior wall 57 and the peripheral rim 53 of the diffuser plate 50 may vary to obtain the desired velocity of the water at this point. As the water moves upwards along the periphery of the tank interior, it will counter and nullify any tendency towards establishing downward moving convection currents. By minimizing the convection currents that cause mixing, by minimizing thermal imbalance, by reducing velocity and by creating counter currents, any heat transfer from heated water to cold water will be largely due to thermal conduction which is a slow process. In this manner, mixing losses are minimized.

Figure 5:
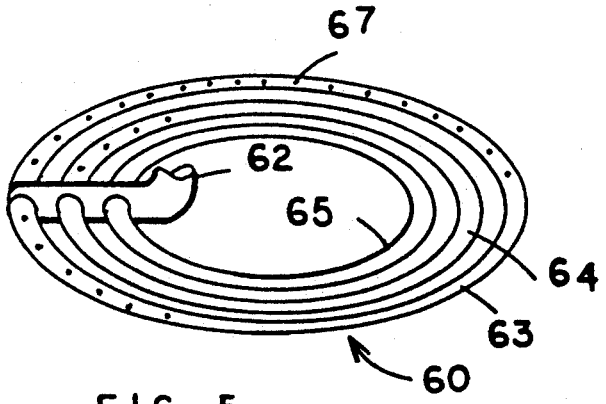
FIG. 5 is an enlarged, perspective view of another embodiment of the invention with the inlet dip tube having a diffuser portion.
Figure 6:
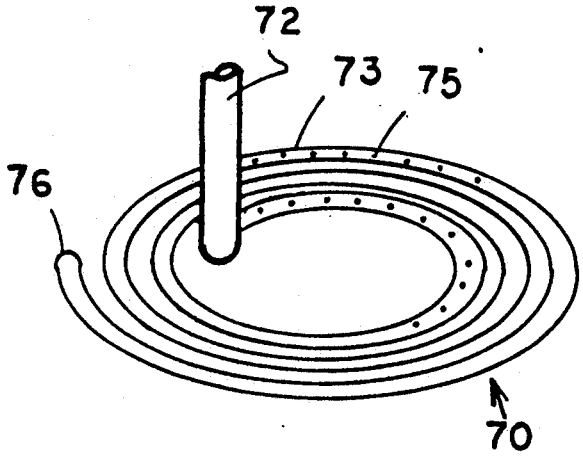
FIG. 6 is an enlarged, perspective view of another embodiment of a diffuser portion of the inlet dip tube.
Figure 7:
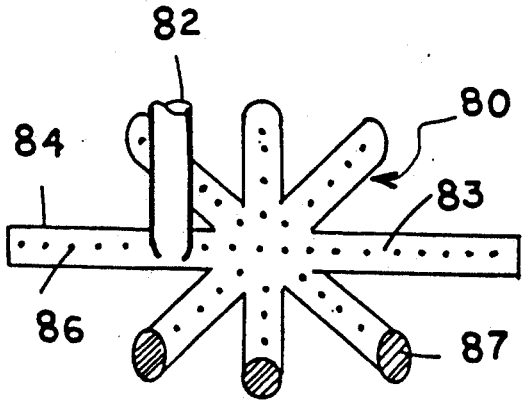
FIG. 7 is an enlarged, perspective view of another embodiment of a diffuser portion of the inlet dip tube.

FIGS. 5, 6 and 7 represent alternate shapes and forms for an inlet dip tube which includes a diffuser portion at the lower end thereof. In each embodiment, the diffuser openings introduce cold water from one horizontal cross sectional area near the bottom of the water storage chamber thereby reducing the water velocity and minimizing thermal imbalance. Preferably, the openings defined in the diffuser are of such number, size, shape and location to direct inlet water upwardly into the tank uniformly over that single horizontal plane.

In FIG. 5, a dip tube diffuser portion 60 includes a connecting inlet portion 62 and concentric diffusing circles 63, 64 and 65 extending from the inlet portion 62 and extending horizontally around the tank axis from the inlet portion 62. The circles 63, 64 and 65 are each provided with a plurality of spaced openings, a portion of which are shown and collectively designated 67, permitting even introduction of water into the tank.

In FIG. 6, a dip tube diffuser portion 70 includes a connecting inlet portion 72 and a helical water introduction portion 73 extending spirally from the inlet portion 72 horizontally within the tank storage area. The helical tube portion 73 extends one or more substantial turns around the tank axis. As shown in FIG. 6, the tube portion 73 may be wrapped or coiled around the tank axis for more than 360 degrees. The helical tube portion 73 is provided with a plurality of openings, a portion of which are shown and collectively designated 75, permitting introduction of water evenly into the tank. The free end 76 of the helical tube portion 73 is closed.

In FIG. 7, a dip tube diffuser portion 80 includes a connecting inlet portion 82 and a spider-shaped water introduction portion 83 with horizontal branch segments, one of which is designated 84, extending outward from the inlet portion 82. The inlet portion extends from the tank inlet dip tube towards the tank wall so that the branch segments 84 are radially arranged. The branch segments 84 are provided with a plurality of spaced openings, collectively designated 86, permitting introduction of water evenly into the tank. The free ends, one of which is designated 87, of the branch segments 84 are closed.

Figure 9:
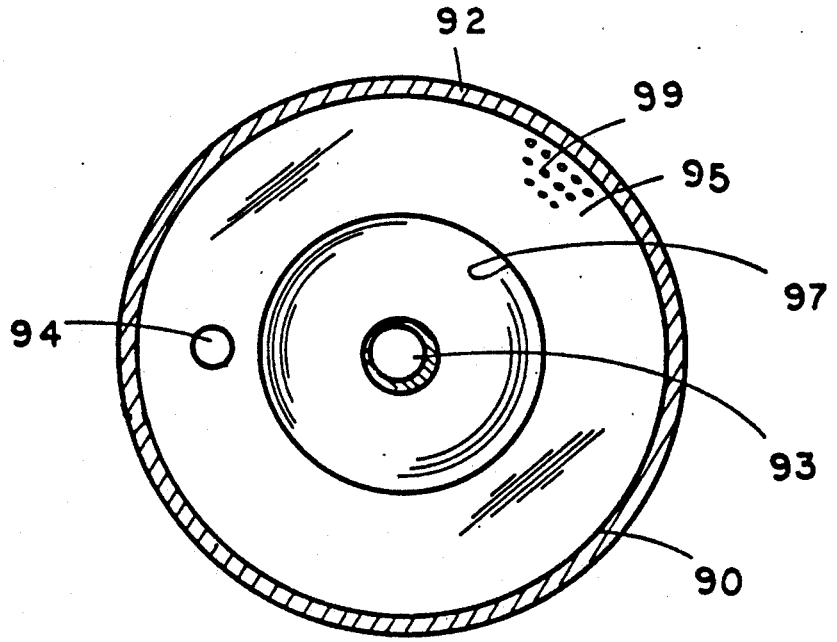
FIG. 9 is a cross-sectional view of the tank taken along line 9—9 of FIG. 8 showing an exemplary embodiment of the dispersing plate.
Figure 8:
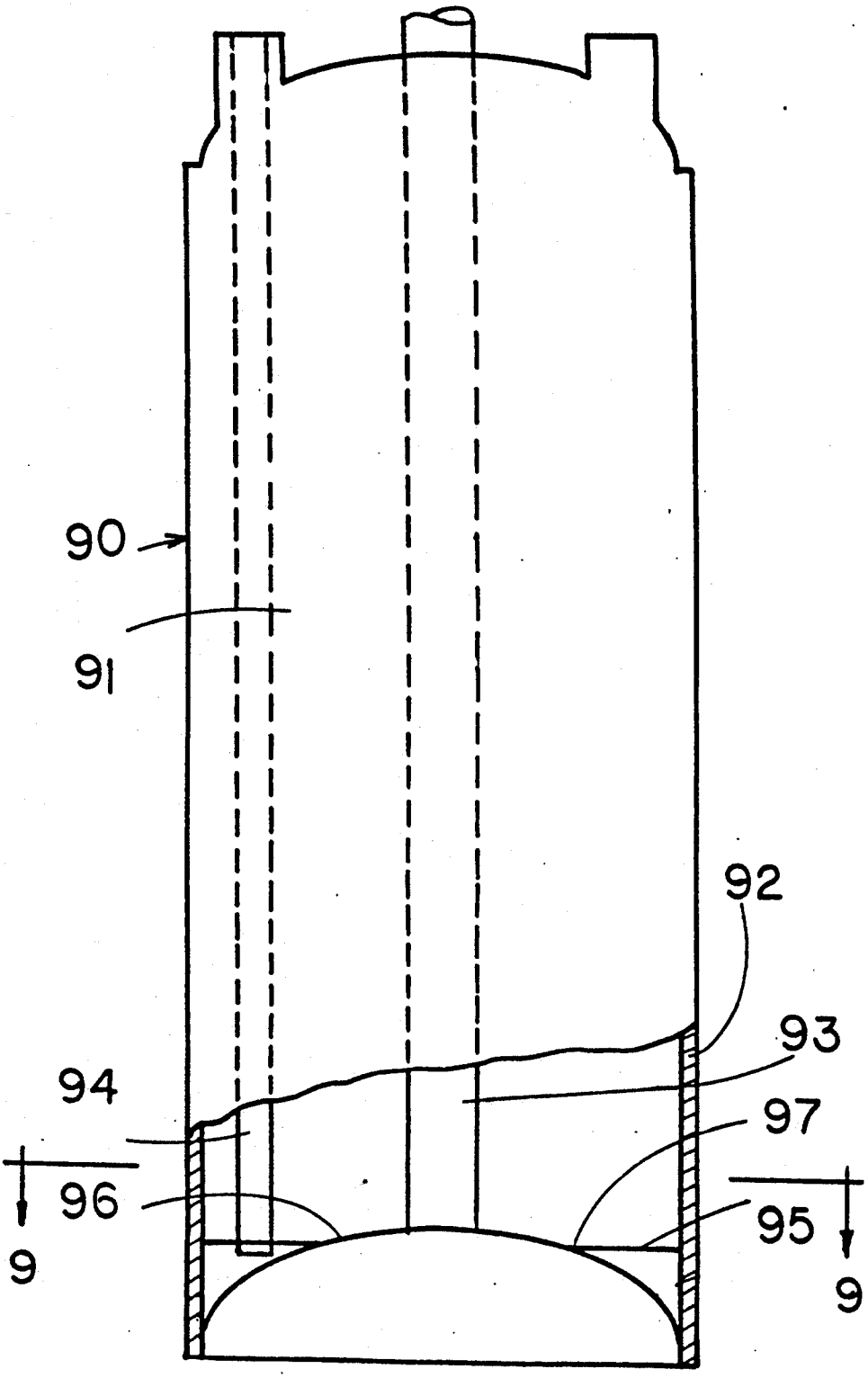
FIG. 8 is a side elevational view, partially in section, of a gas water heater showing a dispersing plate below dome level.

In FIGS. 8 and 9, another embodiment of the invention is shown. Herein, a water heater, generally designated 90, has a tank 91 with a cylindrical side wall 92, a central exhaust gas flue 93, an inlet dip tube 94 and a diffuser plate 95. The inlet dip tube 94 communicates with the tank inlet and is disposed generally adjacent the bottom of the tank storage area. The inlet dip tube 94 extends below the diffuser plate 95, while the diffuser plate 95 is disposed below the dome level 96. The diffuser plate 95 includes a large central annular opening 97 to allow it to be situated below the dome level 96. The outer periphery of the diffuser plate 95 may optionally contact the tank's interior and the inner periphery of the plate annular opening 97 may optionally contact with the bottom dome. The diffuser plate 95 has plurality of radially and circumferentially spaced relatively small openings, collectively designated 99, over its entire surface to permit uniform dispersal of inlet water. For clarity, only a small portion of the openings 99 are shown in FIG. 9. Alternately, the diffuser plate 95 may be solid with no openings, but defines a continuous space between its outer periphery and the inside periphery of the tank.

Figure 10:
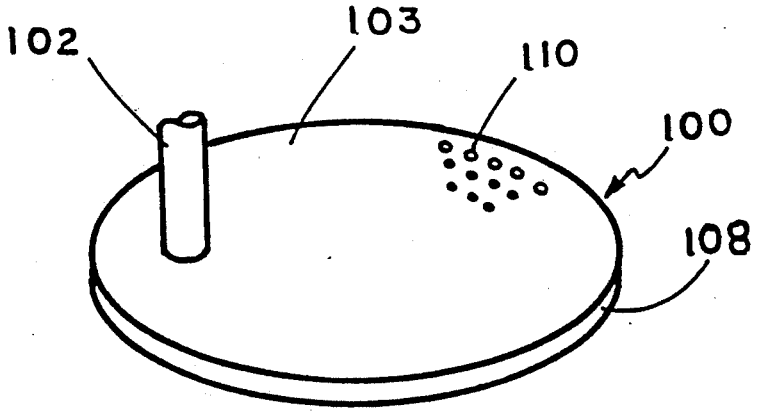
FIG. 10 is an enlarged, perspective view of another embodiment of a diffuser portion of the inlet dip tube.
Figure 10A:
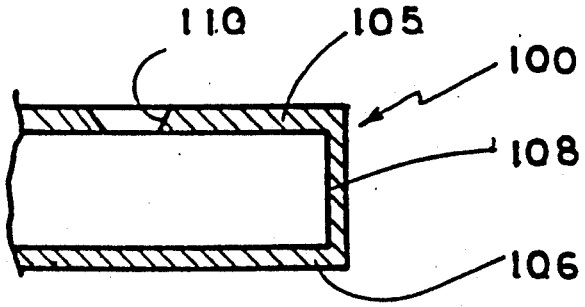
FIG. 10A is a partial, cross-sectional view of a portion of the diffuser plate of FIG. 10.

In FIGS. 10 and 10A, a dip tube diffuser portion 100 includes a connecting inlet portion 102 and a disk-shaped hollow water introduction portion 103. The shallow pan water introduction portion 103 comprises two spaced plates 105 and 106 closed along their circumference by peripheral side wall 108 to encase the hollow interior. The upper plate 105 has a plurality of spaced openings, collectively designated 110, permitting introduction of water evenly into the tank from the pan interior. In FIG. 10, only a small number of the openings 110 defined in the upper plate 105 are illustrated. The openings 110 may be defined by outwardly tapered bores as shown in FIG. 10A.

Figure 11:
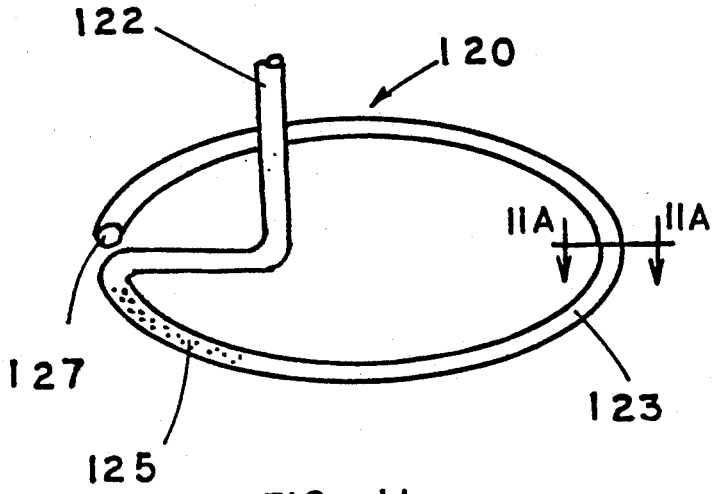
FIG. 11 is an enlarged, perspective view of another embodiment of a diffuser portion of the inlet dip tube; and, FIG. 11A is a cross-sectional view of a portion of the diffuser tube taken along line 11A—11A of FIG. 11.
Figure 11A:
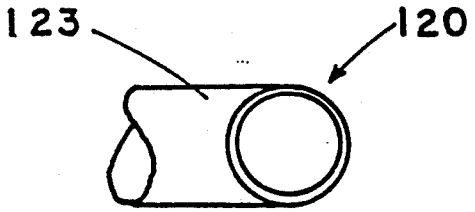

In FIGS. 11 and 11A, a dip tube diffuser portion 120 includes a connecting inlet portion 122 and a near circular water introduction tube portion 123 extending radially outward from the inlet portion 122 and then extending horizontally around the tank central axis and adjacent to the tank's circumferential side wall for approximately one turn. The arcuate tube portion 123 is provided with a plurality of spaced openings, a portion of which are shown along one segment of the tube and collectively designated 125, communicating with the tube interior to permit even introduction of water upwardly into the tank. The free end 127 of the circular tube portion 123 is closed.

Industrial Applicability

From the foregoing, it should be apparent that the storage tank described herein is simple and inexpensive, yet provides a convenient and reliable means for delivering more hot water from the tank outlet at a relatively higher temperature over an extended period of time.

Other aspects, objects and advantages of this invention can be obtained from a study of the drawings, the disclosure and the appended claims.

What is claimed is:

1. In a vertical storage tank having a side wall, a bottom wall and a top wall defining an internal storage area for heated fluid, an inlet for introducing fluid into the bottom portion of the tank and an outlet for withdrawing fluid from the top portion of the tank, the improvement comprising an inlet diffuser located in the bottom portion of the tank below the outlet and extending in a horizontal plane, said diffuser having a plurality of spaced openings relatively smaller across at least one transverse axis than the diffuser inlet and defining a path for the flow of inlet fluid into the tank, said diffuser being substantially circumferentially uniform to provide an even layer of inlet fluid within the tank, whereby incoming fluid is dispersed from a plurality of openings across a relatively thin horizontal cross section of the tank and uniformly delivered to the tank storage area above the diffuser to foil convection currents that cause mixing of hot and cold fluid so that more hot fluid is recovered at the outlet over time.

2. The storage tank of claim 1 wherein said diffuser is a horizontal plate extending across the tank, said plate being perforated by a plurality of holes relatively smaller than the diffuser inlet over its entire surface to permit uniform fluid dispersion through the diffuser from below.

3. The storage tank of claim 2 wherein said holes nearer to the inlet in the diffuser plate have smaller openings than holes further from the inlet.

4. The storage tank of claim 2 wherein said plate holes have a horizontal cross section increasing in the direction of fluid flow through said holes.

5. In a vertical storage tank having a side wall, a bottom wall and a top wall defining an internal storage area for heated fluid, an inlet for introducing fluid into the bottom portion of the tank and an outlet for withdrawing fluid from the top portion of the tank, the improvement comprising an inlet diffuser located in the bottom portion of the tank below the outlet and extending in a horizontal plane, said diffuser being a horizontal plate extending across the tank with its circumferential edge radially spaced from the side wall of the tank to define a narrow space therebetween, said diffuser defining a path for the flow of inlet fluid into the tank and being substantially circumferentially uniform to provide an even layer of inlet fluid within the tank, whereby including fluid is introduced from a plurality of points along a relatively thin horizontal cross section of the tank and uniformly delivered to the tank storage area above the diffuser to foil convection currents that cause mixing of hot and cold fluid so that more hot fluid is recovered at the outlet over time.

6. The storage tank of claim 5 wherein said circumferential edge of the horizontal plate is upwardly formed.

7. The storage tank of claim 1 wherein said diffuser has a connecting portion communicating with the inlet and a delivery portion with parts thereof being spaced radially from and circumferentially about the central axis of the tank and having spaced openings for delivering fluid into the bottom portion of the tank, said delivery portion being entirely within the tank.

8. The storage tank of claim 7 wherein said delivery portion is a circular tube and extends around the tank axis in a horizontal plane.

9. The storage tank of claim 7 wherein said delivery portion is an arcuate tube and extends around the tank axis in a horizontal plane for at least one substantial turn.

10. The storage tank of claim 7 wherein said delivery portion is a helical tube and extends around the tank axis in a horizontal plane for more than 360 degrees.

11. The storage tank of claim 7 wherein said delivery portion is a tube comprising spider with a plurality of spider segments extending radially outward in a horizontal plane.

12. The storage tank of claim 7 further including a downwardly extending inlet dip tube radially spaced from the central axis of the tank and wherein said connecting portion is spaced from the tank axis.

13. The storage tank of claim 7 wherein the openings nearer the inlet are smaller than the openings further from said inlet point.

14. In a vertical storage tank having a side wall, a bottom wall and a top wall defining an internal storage area for heated fluid, an inlet for introducing fluid into the bottom portion of the tank and an outlet for withdrawing fluid from the top portion of the tank, the improvement comprising an inlet diffuser located in the bottom portion of the tank below the outlet and extending in a horizontal plane, said diffuser defining a path for the flow of inlet fluid into the tank, said diffuser being substantially circumferentially uniform to provide an even layer of inlet fluid within the tank, the bottom wall being inwardly concave to define a domed tank bottom, said diffuser being a horizontal plate extending across the tank and having a central opening, and said tank dome extending into said opening, whereby incoming fluid is introduced from a plurality of points across a relatively thin horizontal cross section of the tank and uniformly delivered to the tank storage area above the diffuser to foil convection currents that cause mixing of hot and cold fluid so that more hot fluid is recovered at the outlet over time.

15. The storage tank of claim 14 wherein said plate abuts the side wall of the tank and is perforated with a plurality of holes relatively smaller across at least one transverse axis than the diffuser inlet over its entire surface to permit uniform fluid dispersion through the diffuser from below.

16. The storage tank of claim 14 wherein said plate extends across the tank and is radially spaced from the side wall of the tank to define a narrow space therebetween and to permit fluid flow past the diffuser from below.

17. The storage tank of claim 1 wherein said diffuser is a horizontal shallow pan encased on all sides, said diffuser extending across the tank and being perforated by a plurality of relatively small holes through its upper surface to permit inlet fluid flow through the diffuser.

18. In a vertical storage tank having a side walls, a bottom wall and a top wall defining an internal storage area for heated fluid, an inlet for introducing fluid into the bottom portion of the tank and an outlet for withdrawing fluid from the top portion of the tank, the improvement comprising an inlet diffuser located in the bottom portion of the tank below the outlet and extending in a horizontal plane, said diffuser having a plurality of spaced openings relatively smaller across at least on transverse axis than the diffuser inlet and defining a path at a plurality of locations spaced horizontally from the tank central axis for the flow of inlet fluid into the tank storage area above said diffuser, each location permitting a relatively small volume of inlet fluid to flow from the inlet into the tank storage area at relatively low velocity so as to provide an even layer of inlet fluid within the tank, whereby incoming fluid is dispersed from a plurality of points along a relatively thin horizontal cross section of the tank and uniformly delivered to the tank storage area above the diffuser to foil convection currents that cause mixing of hot and cold fluid so that more hot fluid is recovered at the outlet over time.

19. The storage tank of claim 18 wherein said inlet flow path is defined by a series of radially and circumferentially spaced openings in the diffuser.

20. The storage tank of claim 18 wherein said inlet flow path is defined by a single narrow opening extending circumferentially adjacent the tank side wall.

* * * * *